US005565420A

United States Patent [19]

Stearns

[11] Patent Number: 5,565,420

[45] Date of Patent: Oct. 15, 1996

[54] GRANULAR DETERGENT COMPOSITION CONTAINING ADMIXED FATTY ALCOHOLS FOR IMPROVED COLD WATER SOLUBILITY

[75] Inventor: Charles L. Stearns, Cincinnati, Ohio

[73] Assignee: The Procter & Gamble Company, Cincinnati, Ohio

[21] Appl. No.: 469,236

[22] Filed: Jun. 6, 1995

Related U.S. Application Data

[63] Continuation-in-part of Ser. No. 243,668, May 16, 1994, abandoned.

[51] Int. Cl.[6] ..... C11D 3/20; C11D 3/08; C11D 3/10; C11D 1/37

[52] U.S. Cl. ..... 510/358; 510/276; 510/352; 510/361; 510/446; 252/363.5

[58] Field of Search ..... 252/165, 170, 252/135, 551, 532, 174.14, 174.23, DIG. 2, 559, 540, 363.5

[56] References Cited

U.S. PATENT DOCUMENTS

| | | | |
|---|---|---|---|
| H1,468 | 8/1995 | Costa et al. | 252/174.12 |
| 2,381,960 | 8/1945 | Johnson | 210/23 |
| 2,527,075 | 10/1950 | Preston | 252/121 |
| 2,746,932 | 5/1956 | Vitale | 252/135 |
| 2,855,367 | 10/1958 | Buck | 252/138 |
| 2,867,585 | 1/1959 | Vitale | 252/135 |
| 2,956,026 | 10/1960 | Lew | 252/161 |
| 3,720,629 | 3/1973 | Sharman | 252/535 |
| 3,764,542 | 10/1973 | Natali et al. | 252/135 |
| 4,108,780 | 8/1978 | Thomas | 252/8.6 |
| 4,125,475 | 11/1978 | Kolaian et al. | 252/135 |
| 4,169,074 | 9/1979 | Conrad et al. | 252/544 |
| 4,299,717 | 11/1981 | Cottrell et al. | 252/99 |
| 4,490,271 | 12/1984 | Spadini et al. | 252/174.23 |
| 4,507,219 | 3/1985 | Hughes | 252/118 |
| 4,715,979 | 12/1987 | Moore et al. | 252/91 |
| 5,066,419 | 11/1991 | Walley et al. | 252/174.11 |
| 5,089,174 | 2/1992 | Kaw et al. | 252/553 |
| 5,180,515 | 1/1993 | Boucher et al. | 252/135 |

FOREIGN PATENT DOCUMENTS

| | | | |
|---|---|---|---|
| 0210721A3 | 2/1987 | European Pat. Off. | C11D 3/37 |
| WO94/01526 | 6/1993 | WIPO | C11D 17/06 |

OTHER PUBLICATIONS

Chemical Abstracts, vol. 119, No. 10, 6 Sep. 1993, Columbus, Ohio, U.S.; Abstract No. 98504, see abstract & PL, A, 156 470 (Inst. Chemii Prezemyslowei) 31 Mar. 1992.

DATABASE WPI, Section Ch, Week 9227, Derwent Publications Ltd., London, GB; Class D25, AN 92–222659 & JP–A–04 146 998 (Lion Corp), 20 May 1992; see abstract.

*Primary Examiner*—Paul Lieberman
*Assistant Examiner*—Lorna M. Douyon
*Attorney, Agent, or Firm*—Ken K. Patel; Jacobus C. Rasser; Jerry J. Yetter

[57] ABSTRACT

A granular detergent composition having improved solubility or dispersability in laundering solutions is provided. The detergent composition contains especially selected amounts of detergent composition ingredients including: (a) from about 5% to about 20% by weight of a $C_{12-14}$ linear alkylbenzene sulfonate surfactant; (b) from about 5% to about 20% by weight of a $C_{14-15}$ alkyl sulfate surfactant; (c) from about 0.1% to about 10% by weight of a $C_{14-15}$ alkyl ethoxylated sulfate surfactant having an average degree of ethoxylation of from about 1 to 9; (d) from about 0.1% to about 5% by weight of polyethylene glycol; (e) from about 0.1% to about 5% by weight of polyacrylate; (f) from about 10% to about 35% by weight of aluminosilicate builder; (g) from about 10% to about 35% by weight of sodium carbonate; and (h) from about 0.1% to about 5% by weight of a $C_{10-14}$ fatty alcohol.

9 Claims, No Drawings

GRANULAR DETERGENT COMPOSITION CONTAINING ADMIXED FATTY ALCOHOLS FOR IMPROVED COLD WATER SOLUBILITY

CROSS REFERENCE TO RELATED APPLICATION

This is a Continuation-In-Part application of application Ser. No. 08/243,668, filed May 16, 1994, now abandoned.

FIELD OF THE INVENTION

The present invention generally relates to a granular detergent composition having improved solubility in cold temperature laundering solutions. More particularly, the granular detergent composition contains a low melting point fatty alcohol which is sprayed-on or admixed to the detergent granules resulting in a finished detergent composition having improved cold water solubility.

BACKGROUND OF THE INVENTION

In the art of detergency, granular laundry detergents containing admixed sodium carbonate have been found to exhibit poor water solubility under certain conditions. For example, in countries which typically launder clothes in relatively cold temperature (e.g. 2° C. to 30° C.) washing solutions, the solubility of carbonate-containing granular detergent compositions has not been satisfactorily complete. After undergoing a conventional laundering process in these situations, solid masses or "clumps" of detergent ranging from about 5 to 40 mm in diameter and about 2 to 10 mm in length remain in the washing machine and deposited on the laundered clothes. Such clumps usually occur when the detergent is placed in a pile, particularly during cold temperature washes and/or when the order of addition to the washing machine is laundry detergent first, clothes second, and water last (the so-called "reverse order of addition"). This solubility problem is easily identifiable by consumers of such granular detergents and is commercially unacceptable.

It has been known that the primary contributor to the aforementioned solubility problem is the admixed sodium carbonate in the granular laundry detergent. While not intending to be limited by theory, it is believed that this solubility problem is caused by hydration of the sodium carbonate, which results in a sticky, poorly soluble solid mass, before the granular detergent can be completely dispersed and dissolved in the laundering solution. It is important to note that this problem is normally only associated with granular detergents containing "admixed" sodium carbonate, i.e. carbonate which is subsequently mixed with or added to the base granule. By contrast, granular detergents containing sodium carbonate which forms part of the base granule by way of being added to the crutcher and spray dried in conjunction with the other base granule ingredients typically does not experience the cold water solubility problem to which the present invention is directed.

As is known, citric acid has been used as a builder in granular laundry detergents. Additionally, citric acid has been used in some cases to increase the water solubility of granular detergents containing sodium carbonate and the like by way of a chemical reaction between the citric acid and sodium carbonate to release carbon dioxide. However, the citric acid ingredient has long been regarded as a relatively expensive component of modern day granular detergents and thus only low levels have been used to produce detergent products economically acceptable for consumers. Additionally, citric acid is known to be hygroscopic and thus contribute to undesirable caking of the detergent product prior to use by the consumer. It would therefore desirable to have a lower cost material which would provide the solubility benefits desired and reduce or eliminate the need for the citric acid component in granular detergents.

Accordingly, it would be desirable to have a granular detergent composition which exhibits improved water solubility, especially at cold temperatures. It would also be desirable to have such a granular detergent which is less expensive.

BACKGROUND ART

The following patents disclose granular detergent compositions containing sodium carbonate: Cottrell et al, U.S. Pat. No. 4,299,717; Johnson, U.S. Pat. No. 2,381,960. The following patents disclose granular detergent compositions containing citric acid: Hughes, U.S. Pat. No. 4,507,219; Conrad et al, U.S. Pat. No. 4,169,074; and Moore et al, U.S. Pat. No. 4,715,979. Also, other granular detergent compositions containing carbonate are disclosed by Boucher et al, U.S. Pat. No. 5,180,515.

SUMMARY OF THE INVENTION

The present invention meets the needs identified above by providing a granular detergent composition which surprisingly exhibits improved water solubility as evidenced by reduced amounts of solid masses or clumps found subsequent to conventional laundering processes. This unexpected result is especially noticeable when the granular detergent is used in laundering solutions kept at cold temperatures (e.g. 2° C. to 30° C.). The invention achieves the desired result by incorporating a low melting point fatty alcohol onto the base detergent granules. The fatty alcohol ingredient provides a suitable low-cost alternative to components such as citric acid in that it surprisingly enhances the water solubility of the granular detergent as evidenced by the reduction of visible clumps or solid masses of detergent remaining on the laundered clothes and/or in the washing machine.

In accordance with one aspect of the invention, a granular detergent composition surprisingly exhibiting improved solubility in cold temperature laundering solutions is provided. Specifically, the granular detergent composition comprises from about 1% to about 75% of a detersive surfactant, from about 1% to about 90% of a detergency builder, and an effective amount of a fatty alcohol having a melting point of from about 6° C. to about 70° C. to improve the solubility of the composition in an aqueous laundering solution. In one embodiment, the fatty alcohol has from 10 to 14 carbon atoms and is present in an amount from about 1% to about 10% by weight.

In another embodiment of the invention, the surfactant is selected from the group consisting of alkyl benzene sulfonates, alkyl ester sulfonates, alkyl ethoxylates, alkyl phenol alkoxylates, alkylpoly glucosides, alkyl sulfates, alkyl ethoxy sulfate, secondary alkyl sulfates and mixtures thereof. Preferably, the surfactant is a mixture of alkyl sulfate and alkyl ethoxy sulfate surfactants. Optionally, the detergent composition further includes adjunct ingredients selected from the group consisting of selected from the group consisting of bleaches, bleach activators, suds suppressors, enzyme stabilizers, polymeric dispersing agents, dye transfer inhibitors and soil release agents. In a preferred embodiment, the detergency builder is selected from the group consisting of sodium carbonate, zeolites and mixtures thereof.

In an especially preferred embodiment of the invention, a detergent composition having optimally selected components yielding unexpected superior solubility in laundering solutions which leads to improved cleaning. The detergent composition contains especially selected amounts of detergent composition ingredients including: (a) from about 5% to about 20% by weight of a $C_{12-14}$ linear alkylbenzene sulfonate surfactant; (b) from about 5% to about 20% by weight of a $C_{14-15}$ alkyl sulfate surfactant; (c) from about 0.1% to about 10% by weight of a $C_{14-15}$ alkyl ethoxylated sulfate surfactant having an average degree of ethoxylation of from about 1 to 9; (d) from about 0.1% to about 5% by weight of polyethylene glycol; (e) from about 0.1% to about 5% by weight of polyacrylate; (f) from about 10% to about 35% by weight of aluminosilicate builder; (g) from about 10% to about 35% by weight of sodium carbonate; and (h) from about 0.1% to about 5% by weight of a $C_{10-14}$ fatty alcohol.

In another aspect of the invention, a method for laundering soiled fabrics is provided which comprises the step of contacting the soiled fabrics with an effective amount of a detergent composition according to the invention in an aqueous laundering solution.

All percentages, ratios and proportions used herein are by weight, unless otherwise specified. All documents including patents and publications cited herein are incorporated herein by reference.

Accordingly, it is an object of the invention to provide a granular detergent composition which exhibits improved solubility in aqueous laundering solutions, especially those laundering solutions kept at cold temperatures. It is also an object of the invention to provide such a granular detergent composition which is less expensive yet provides the desired solubility characteristics. These and other objects, features and attendant advantages of the present invention will become apparent to those skilled in the art from a reading of the following detailed description of the preferred embodiment and the appended claims.

DETAILED DESCRIPTION OF THE PREFERRED EMBODIMENT

In its broadest aspect, the granular composition of the invention contains a surfactant, builder and low melting point fatty alcohol. The unexpected results exhibited by the invention are especially prevalent in granular compositions containing admixed sodium carbonate, i.e. sodium carbonate which does not form part of the base granule. Typically, such granular detergent compositions include from about 5% to about 70%, preferably from about 8% to about 50% and most preferably from about 11% to about 30% by weight of sodium carbonate ($Na_2CO_3$). Additionally, the improved solubility and reduction of residual solid masses or clumps of detergent after washing cycles is also surprisingly experienced with condensed or "compact" detergent compositions which are increasingly used by consumers. The detergent composition achieves the desired solubility characteristics without phosphates. This enhances the attractiveness of the composition from an environmental standpoint, as well.

FATTY ALCOHOL

The composition preferably contains from about 1% to about 10%, more preferably from about 2% to about 4%, and most preferably from about 2.2% to about 3.8% by weight of a fatty alcohol having a melting point of from about 1° C. to about 70° C., more preferably from about 5° C. to about 60° C., and most preferably from about 6° C. to about 50° C. Of the numerous fatty alcohols which meet the aforementioned characteristics, $C_{10-14}$ fatty alcohols are the more preferred class, within which the $C_{10}$ fatty alcohol is the most preferred. While not intending to be bound by theory, it is believed that the fatty alcohols which are preferably sprayed onto the base granules sufficiently interfere with the hydration of sodium carbonate which occurs during conventional laundering processes, especially those employing cold temperature laundering solutions. In this way, the formation of solid masses or clumps of detergent as a result of the rapid hydration of sodium carbonate and like salts is minimized resulting in enhanced solubility or dispersability of the detergent.

SURFACTANT

A detersive surfactant is preferably included in the composition in an amount from about 1% to about 75%, more preferably from about 10% to about 55% and most preferably from about 20% to about 45% by weight. Nonlimiting examples of the preferred surfactants useful in the surfactant system include the conventional primary, branched-chain and random $C_{10}$-$C_{20}$ alkyl sulfates ("AS"), the $C_{10}$-$C_{18}$ secondary (2,3) alkyl sulfates of the formula $CH_3(CH_2)_x(CHOSO_3^-M^+)CH_3$ and $CH_3(CH_2)_y(CHOSO_3^-M^+)CH_2CH_3$ where x and (y+1) are integers of at least about 7, preferably at least about 9, and M is a water-solubilizing cation, especially sodium, unsaturated sulfates such as oleyl sulfate, and the $C_{10}$-$C_{18}$ alkyl alkoxy sulfates ("$AE_xS$"; especially EO 1–7 ethoxy sulfates).

Other surfactants useful in the composition of the invention include $C_{11}$-$C_{18}$ alkyl benzene sulfonates ("LAS") and $C_{10}$-$C_{18}$ alkyl alkoxy carboxylates (especially the EO 1–5 ethoxycarboxylates), the $C_{10-18}$ glycerol ethers, the $C_{10}$-$C_{18}$ alkyl polyglycosides and their corresponding sulfated polyglycosides, and $C_{12}$-$C_{18}$ alpha-sulfonated fatty acid esters. If desired, the conventional nonionic and amphoteric surfactants such as the $C_{12}$-$C_{18}$ alkyl ethoxylates ("AE") including the so-called narrow peaked alkyl ethoxylates and $C_6$-$C_{12}$ alkyl phenol alkoxylates (especially ethoxylates and mixed ethoxy/propoxy), $C_{12}$-$C_{18}$ betaines and sulfobetaines ("sultaines"), $C_{10}$-$C_{18}$ amine oxides, and the like, can also be included in the overall compositions. The $C_{10}$-$C_{18}$ N-alkyl polyhydroxy fatty acid amides can also be used. Typical examples include the $C_{12}$-$C_{18}$ N-methylglucamides. See WO 9,206,154. Other sugar-derived surfactants include the N-alkoxy polyhydroxy fatty acid amides, such as $C_{10}$-$C_{18}$ N-(3-methoxypropyl) glucamide. The N-propyl through N-hexyl $C_{12}$-$C_{18}$ glucamides can be used for low sudsing. $C_{10}$-$C_{20}$ conventional soaps may also be used. If high sudsing is desired, the branched-chain $C_{10}$-$C_{16}$ soaps may be used. Mixtures of anionic and nonionic surfactants are especially useful. Other conventional useful surfactants are listed in standard texts.

DETERGENCY BUILDER

Detergent builders can optionally be included in the compositions herein to assist in controlling mineral hardness. Inorganic as well as organic builders can be used. Builders are typically used in fabric laundering compositions to assist in the removal of particulate soils.

The level of builder can vary widely depending upon the end use of the composition and its desired physical form. When present, the compositions will typically comprise at least about 1% builder. Granular formulations typically comprise from about 10% to about 80%, more typically from about 15% to about 50% by weight, of the detergent builder. Lower or higher levels of builder, however, are not meant to be excluded.

Inorganic or P-containing detergent builders include, but are not limited to, the alkali metal, ammonium and alkanolammonium salts of polyphosphates (exemplified by the tripolyphosphates, pyrophosphates, and glassy polymeric meta-phosphates), phosphonates, phytic acid, silicates, carbonates (including bicarbonates and sesquicarbonates), sulphates, and aluminosilicates. However, non-phosphate builders are required in some locales. Importantly, the compositions herein function surprisingly well even in the presence of the so-called "weak" builders (as compared with phosphates) such as citrate, or in the so-called "underbuilt" situation that may occur with zeolite or layered silicate builders.

Examples of silicate builders are the alkali metal silicates, particularly those having a $SiO_2$:$Na_2O$ ratio in the range 1.6:1 to 3.2:1 and layered silicates, such as the layered sodium silicates described in U.S. Pat. No. 4,664,839, issued May 12, 1987 to H. P. Rieck. NaSKS-6 is the trademark for a crystalline layered silicate marketed by Hoechst (commonly abbreviated herein as "SKS-6"). Unlike zeolite builders, the Na SKS-6 silicate builder does not contain aluminum. NaSKS-6 has the delta-$Na_2SiO_5$ morphology form of layered silicate. It can be prepared by methods such as those described in German DE-A-3,417,649 and DE-A-3,742,043. SKS-6 is a highly preferred layered silicate for use herein, but other such layered silicates, such as those having the general formula $NaMSi_xO_{2x+1}.yH_2O$ wherein M is sodium or hydrogen, x is a number from 1.9 to 4, preferably 2, and y is a number from 0 to 20, preferably 0 can be used herein. Various other layered silicates from Hoechst include NaSKS-5, NaSKS-7 and NaSKS-11, as the alpha, beta and gamma forms. As noted above, the delta-$Na_2SiO_5$ (NaSKS-6 form) is most preferred for use herein. Other silicates may also be useful such as for example magnesium silicate, which can serve as a crisping agent in granular formulations, as a stabilizing agent for oxygen bleaches, and as a component of suds control systems.

Examples of carbonate builders are the alkaline earth and alkali metal carbonates as disclosed in German Patent Application No. 2,321,001 published on Nov. 15, 1973.

Aluminosilicate builders are useful in the present invention. Aluminosilicate builders include those having the empirical formula:

$$M_z(zAlO_2)_y].xH_2O$$

wherein z and y are integers of at least 6, the molar ratio of z to y is in the range from 1.0 to about 0.5, and x is an integer from about 15 to about 264.

Useful aluminosilicate ion exchange materials are commercially available. These aluminosilicates can be crystalline or amorphous in structure and can be naturally-occurring aluminosilicates or synthetically derived. A method for producing aluminosilicate ion exchange materials is disclosed in U.S. Pat. No. 3,985,669, Krummel, et al, issued Oct. 12, 1976. Preferred synthetic crystalline aluminosilicate ion exchange materials useful herein are available under the designations Zeolite A, Zeolite P (B), Zeolite MAP and Zeolite X. In an especially preferred embodiment, the crystalline aluminosilicate ion exchange material has the formula:

$$Na_{12}[(AlO_2)_{12}(SiO_2)_{12}].xH_2O$$

wherein x is from about 20 to about 30, especially about 27. This material is known as Zeolite A. Dehydrated zeolites (x=0–10) may also be used herein. Preferably, the aluminosilicate has a particle size of about 0.1–10 microns in diameter.

Organic detergent builders suitable for the purposes of the present invention include, but are not restricted to, a wide variety of polycarboxylate compounds. As used herein, "polycarboxylate" refers to compounds having a plurality of carboxylate groups, preferably at least 3 carboxylates. Polycarboxylate builder can generally be added to the composition in acid form, but can also be added in the form of a neutralized salt. When utilized in salt form, alkali metals, such as sodium, potassium, and lithium, or alkanolammonium salts are preferred.

Included among the polycarboxylate builders are a variety of categories of useful materials. One important category of polycarboxylate builders encompasses the ether polycarboxylates, including oxydisuccinate, as disclosed in Berg, U.S. Pat. No. 3,128,287, issued Apr. 7, 1964, and Lamberti et al, U.S. Pat. No. 3,635,830, issued Jan.18, 1972. See also "TMS/TDS" builders of U.S. Pat. No. 4,663,071, issued to Bush et al, on May 5, 1987. Suitable ether polycarboxylates also include cyclic compounds, particularly alicyclic compounds, such as those described in U.S. Pat. Nos. 3,923,679; 3,835,163; 4,158,635; 4,120,874 and 4,102,903.

Other useful detergency builders include the ether hydroxypolycarboxylates, copolymers of maleic anhydride with ethylene or vinyl methyl ether, 1,3,5-trihydroxy benzene-2,4,6-trisulphonic acid, and carboxymethyloxysuccinic acid, the various alkali metal, ammonium and substituted ammonium salts of polyacetic acids such as ethylenediamine tetraacetic acid and nitrilotriacetic acid, as well as polycarboxylates such as mellitic acid, succinic acid, oxydisuccinic acid, polymaleic acid, benzene 1,3,5-tricarboxylic acid, carboxymethyloxysuccinic acid, and soluble salts thereof.

Citrate builders, e.g., citric acid and soluble salts thereof (particularly sodium salt), are polycarboxylate builders of particular importance for detergent formulations due to their availability from renewable resources and their biodegradability. Citrates can also be used in granular compositions, especially in combination with zeolite and/or layered silicate builders. Oxydisuccinates are also especially useful in such compositions and combinations.

Also suitable in the detergent compositions of the present invention are the 3,3-dicarboxy-4-oxa-1,6-hexanedioates and the related compounds disclosed in U.S. Pat. No. 4,566,984, Bush, issued Jan. 28, 1986. Useful succinic acid builders include the $C_5$-$C_{20}$ alkyl and alkenyl succinic acids and salts thereof. A particularly preferred compound of this type is dodecenylsuccinic acid. Specific examples of succinate builders include: laurylsuccinate, myristylsuccinate, palmitylsuccinate, 2-dodecenylsuccinate (preferred), 2-pentadecenylsuccinate, and the like. Laurylsuccinates are the preferred builders of this group, and are described in European Patent Application 86200690.5/0,200,263, published Nov. 5, 1986.

Other suitable polycarboxylates are disclosed in U.S. Pat. No. 4,144,226, Crutchfield et al, issued Mar. 13, 1979 and in U.S. Pat. No. 3,308,067, Diehl, issued Mar. 7, 1967. See also Diehl U.S. Pat. No. 3,723,322.

Fatty acids, e.g., $C_{12}$-$C_{18}$ monocarboxylic acids, can also be incorporated into the compositions alone, or in combination with the aforesaid builders, especially citrate and/or the succinate builders, to provide additional builder activity. Such use of fatty acids will generally result in a diminution of sudsing, which should be taken into account by the formulator.

In situations where phosphorus-based builders can be used, and especially in the formulation of bars used for hand-laundering operations, the various alkali metal phosphates such as the well-known sodium tripolyphosphates, sodium pyrophosphate and sodium orthophosphate can be used. Phosphonate builders such as ethane-1-hydroxy-1,1-diphosphonate and other known phosphonates (see, for example, U.S. Pat. Nos. 3,159,581; 3,213,030; 3,422,021; 3,400,148 and 3,422,137) can also be used.

ADJUNCT INGREDIENTS

The compositions herein can optionally include one or more other detergent adjunct materials or other materials for assisting or enhancing cleaning performance, treatment of the substrate to be cleaned, or to modify the aesthetics of the detergent composition (e.g., colorants, dyes, perfumes, etc.). The following are illustrative examples of such adjunct materials. Adjunct ingredients include bleaches, bleach activators, suds boosters or suds suppressers, anti-tarnish and anticorrosion agents, soil suspending agents, soil release agents, germicides, pH adjusting agents, non-builder alkalinity sources, chelating agents, smectite clays, enzymes, enzyme-stabilizing agents and perfumes. See U.S. Pat. No. 3,936,537, issued Feb. 3, 1976 to Baskerville, Jr. et al., incorporated herein by reference. Also, fabric conditioning agents may be included as an adjunct material such as those described in U.S. Pat. No. 4,861,502, issued Aug. 29, 1989 to Caswell, incorporated herein by reference.

Bleaching agents and activators are described in U.S. Pat. No. 4,412,934, Chung et al., issued Nov. 1, 1983, and in U.S. Pat. No. 4,483,781, Hartman, issued Nov. 20, 1984, both of which are incorporated herein by reference. Chelating agents are also described in U.S. Pat. No. 4,663,07 1, Bush et al., from Column 17, line 54 through Column 18, line 68, incorporated herein by reference. Suds modifiers are also optional ingredients and are described in U.S. Pat. Nos. 3,933,672, issued Jan. 20, 1976 to Bartoletta et al., and 4,136,045, issued Jan. 23, 1979 to Gault et al., both incorporated herein by reference.

Suitable smectite clays for use herein are described in U.S. Pat. No. 4,762,645, Tucker et al, issued Aug. 9, 1988, Column 6, line 3 through Column 7, line 24, incorporated herein by reference. Suitable additional detergency builders for use herein are enumerated in the Baskerville patent, Column 13, line 54 through Column 16, line 16, and in U.S. Pat. No. 4,663,071, Bush et al, issued May 5, 1987, both incorporated herein by reference.

Enzymes can be included in the formulations herein for a wide variety of fabric laundering purposes, including removal of protein-based, carbohydrate-based, or triglyceride-based stains, for example, and for the prevention of refugee dye transfer, and for fabric restoration. The enzymes to be incorporated include proteases, amylases, lipases, cellulases, and peroxidases, as well as mixtures thereof. Other types of enzymes may also be included. They may be of any suitable origin, such as vegetable, animal, bacterial, fungal and yeast origin. However, their choice is governed by several factors such as pH-activity and/or stability optima, thermostability, stability versus active detergents, builders and so on. In this respect bacterial or fungal enzymes are preferred, such as bacterial amylases and proteases, and fungal cellulases.

Suitable examples of proteases are the *subtilisins* which are obtained from particular strains of *B. subtilis* and *B. licheniforms*. Another suitable protease is obtained from a strain of Bacillus, having maximum activity throughout the pH range of 8–12, developed and sold by Novo Industries A/S under the registered trade name ESPERASE. The preparation of this enzyme and analogous enzymes is described in British Patent Specification No. 1,243,784 of Novo. Proteolytic enzymes suitable for removing protein-based stains that are commercially available include those sold under the trade names ALCALASE and SAVINASE by Novo Industries A/S (Denmark) and MAXATASE by International Bio-Synthetics, Inc. (The Netherlands). Other proteases include Protease A (see European Patent Application 130,756, published Jan. 9, 1985) and Protease B (see European Patent Application Serial No. 87303761.8, filed Apr. 28, 1987, and European Patent Application 130,756, Bott et al, published Jan. 9, 1985).

Amylases include, for example, α-amylases described in British Patent Specification No. 1,296,839 (Novo), RAPIDASE, International Bio-Synthetics, Inc. and TERMAMYL, Novo Industries.

The cellulase usable in the present invention include both bacterial or fungal cellulase. Preferably, they will have a pH optimum of between 5 and 9.5. Suitable cellulases are disclosed in U.S. Pat. No. 4,435,307, Barbesgoard et al, issued Mar. 6, 1984, which discloses fungal cellulase produced from Humicola insolens and Humicola strain DSM1800 or a cellulase 212-producing fungus belonging to the genus Aeromonas, and cellulase extracted from the hepatopancreas of a marine mollusk (Dolabella Auricula Solander). suitable cellulases are also disclosed in GB-A-2.075.028; GB-A-2.095.275 and DE-OS-2.247.832.

Suitable lipase enzymes for detergent usage include those produced by microorganisms of the Pseudomonas group, such as Pseudomonas stutzeri ATCC 19.154, as disclosed in British Patent 1,372,034. See also lipases in Japanese Patent Application 53,20487, laid open to public inspection on Feb. 24, 1978. This lipase is available from Amano Pharmaceutical Co. Ltd., Nagoya, Japan, under the trade name Lipase P "Amano," hereinafter referred to as "Amano-P." Other commercial lipases include Amano-CES, lipases ex Chromobacter viscosum, e.g. Chromobacter viscosum var. lipolyticum NRRLB 3673, commercially available from Toyo Jozo Co., Tagata, Japan; and further Chromobacter viscosum lipases from U.S. Biochemical Corp., U.S.A. and Disoynth Co., The Netherlands, and lipases ex *Pseudomonas gladioli*. The LIPOLASE enzyme derived from *Humicola lanuginosa* and commercially available from Novo (see also EPO 341,947) is a preferred lipase for use herein.

Peroxidase enzymes are used in combination with oxygen sources, e.g., percarbonate, perborate, persulfate, hydrogen peroxide, etc. They are used for "solution bleaching," i.e. to prevent transfer of dyes or pigments removed from substrates during wash operations to other substrates in the wash solution. Peroxidase enzymes are known in the art, and include, for example, horseradish peroxidase, ligninase, and haloperoxidase such as chloro- and bromo-peroxidase. Peroxidase-containing detergent compositions are disclosed, for example, in PCT International Application WO 89/099813, published Oct. 19, 1989, by O. Kirk, assigned to Novo Industries A/S.

A wide range of enzyme materials and means for their incorporation into synthetic detergent compositions are also disclosed in U.S. Pat. No. 3,553,139, issued Jan. 5, 1971 to McCarty et al. Enzymes are further disclosed in U.S. Pat. No. 4,101,457, Place et al, issued Jul. 18, 1978, and in U.S. Pat. No. 4,507,219, Hughes, issued Mar. 26, 1985, both. Enzyme materials useful for liquid detergent formulations, and their incorporation into such formulations, are disclosed in U.S. Pat. No. 4,261,868, Hora et al, issued Apr. 14, 1981. Enzymes for use in detergents can be stabilized by various techniques. Enzyme stabilization techniques are disclosed and exemplified in U.S. Pat. No. 3,600,319, issued Aug. 17, 1971 to Gedge, et al, and European Patent Application Publication No. 0 199 405, Application No. 86200586.5, published Oct. 29, 1986, Venegas. Enzyme stabilization systems are also described, for example, in U.S. Pat. No. 3,519,570.

Additionally, dye transfer inhibiting agents may also be included, for example, polyvinylpyrrolidone, polyamine N-oxide, copolymers of N-vinylpyrrolidone and N-vinylimidazole are a suitable dye transfer inhibiting polymers for use in the present detergent composition. The level of such additional dye transfer inhibiting agents may vary, but typically will be from about 0.01% to about 10% by weight of the detergent composition.

It has been found that the following proportions and detergent ingredients provide surprisingly superior results. The detergent composition contains especially selected amounts of detergent composition ingredients including: (a) from about 5% to about 20%, preferably from about 10% to about 15%, and most preferably from about 10% to about 12%, by weight of a $C_{12-14}$ linear alkylbenzene sulfonate surfactant; (b) from about 5% to about 20%, preferably from about 5% to about 10%, most preferably from about 5% to about 8%, by weight of a $C_{14-15}$ alkyl sulfate surfactant; (c) from about 0.1% to about 10%, more preferably from about 1% to about 5%, most preferably from about 1% to about 3%, by weight of a $C_{14-15}$ alkyl ethoxylated sulfate surfactant having an average degree of ethoxylation of from about 1 to 9, preferably of about 3; (d) from about 0.1% to about 5%, more preferably from about 1% to about 5%, most preferably from about 1% to about 3%, by weight of polyethylene glycol; (e) from about 0.1% to about 5%, more preferably from about 1% to about 5%, most preferably from about 2% to about 4%, by weight of polyacrylate; (f) from about 10% to about 35%, more preferably from about 15% to about 30%, most preferably from about 25% to about 30%, by weight of aluminosilicate builder; (g) from about 10% to about 35%, more preferably from about 15% to about 30%, most preferably from about 25% to about 30%, by weight of sodium carbonate; and (h) from about 0.1% to about 5%, more preferably from about 1% to about 5%, most preferably from about 1.5% to about 3.5%, by weight of a $C_{10-14}$ fatty alcohol.

In order to make the present invention more readily understood, reference is made to the following examples, which are intended to be illustrative only and not intended to be limiting in scope.

EXAMPLE I

Several detergent compositions illustrated below in Table I are made in accordance with the invention in that they have specified amounts of low melting point fatty alcohols sprayed on the detergent granules. Compositions A–E are within the scope of the invention and composition F is outside of the invention as it does not contain the selected fatty alcohol. The relative proportions of compositions A–F are listed in Table I below.

TABLE I

| | % Weight | | | | | |
|---|---|---|---|---|---|---|
| Component | A | B | C | D | E | F |
| $C_{12-14}$ alkylbenzene sulfonate | 10.3 | 10.3 | 10.3 | 10.3 | 10.3 | 10.3 |
| $C_{14-15}$ alkyl sulfate | 6.6 | 6.6 | 6.6 | 6.6 | 6.6 | 6.6 |
| $C_{14-15}$ allyl ethoxylate sulfate (EO = 3) | 1.9 | 1.9 | 1.9 | 1.9 | 1.9 | |
| Polyethylene glycol (MW = 4000) | 2.0 | 2.0 | 2.0 | 2.0 | 2.0 | 2.0 |
| Polyacrylate (MW = 4500) | 3.2 | 3.2 | 3.2 | 3.2 | 3.2 | 3.2 |
| Aluminosilicate | 26.3 | 26.3 | 26.3 | 26.3 | 26.3 | 26.3 |
| Sodium carbonate | 26.3 | 26.3 | 26.3 | 26.3 | 26.3 | 26.3 |
| Sodium sulfate | 10.3 | 10.3 | 10.3 | 10.3 | 10.3 | 10.3 |
| $C_{10}$ fatty alcohol | 3.2 | 1.9 | — | — | — | — |
| $C_{12}$ fatty alcohol | — | — | 3.2 | 1.9 | — | |
| $C_{14}$ fatty alcohol | — | — | — | — | 1.9 | |
| Minors (water, perfume, brightener, etc.) | 9.9 | 11.2 | 9.9 | 11.2 | 11.2 | 13.1 |
| | 100.0 | 100.0 | 100.0 | 100.0 | 100.0 | 100.0 |

Each composition is prepared by forming a base formula of the starting liquids and powdered materials which are combined and subjected to via a variety of known processes including conventional spray drying techniques for detergent granules or agglomeration for agglomerates in apparatus such as powder mixers and fluid beds commercially available from Lödige and Aeromatic, respectively. Agglomeration is especially suitable for preparing modern compact granular detergents and entails initially forming a surfactant paste using standard mixers, after which the paste is agglomerated into agglomerates and dried. Such processing techniques are well known in the art. The enzymes such as cellulases are dry mixed into the base formula and the fatty alcohols described herein and other liquid ingredients such as perfumes are subsequently sprayed onto the base formula so as to form the final granular detergent compositions exemplified herein.

EXAMPLE II

This Example illustrates the surprisingly improved solubility achieved by the detergent composition of the invention. Specifically, standard dosages of compositions A–F (1170 ppm) are dissolved in an aqueous laundering solution having a water temperature of 5° C. and a water hardness of 7 grains/gallon (Ca:Mg ratio of 3:1). Each wash cycle begins by adding detergent product, then soiled clothes, and finally water (also referenced as "ROOR" for "reverse order of addition"). A standard washing cycle is then carried forth. After each conventional laundering process, graders evaluate the laundered clothes and washing machine for residual masses or clumps of detergent product and thereafter assign a score from 0 (worst) to 10 (best). The results are shown in Table II below.

TABLE II

| | A | B | C | D | E | F |
|---|---|---|---|---|---|---|
| Average Grade[1] | 8.1 | 7.7 | 7.3 | 7.1 | 6.9 | 2.2 |

[1]Average grade given to a detergent composition after 24 tests.

From the results in Table II, it is clear that compositions A–E which are within the scope of the invention surprisingly has improved solubility and reduction of residual masses or clumps of detergent over composition F which is outside the scope of the invention (i.e. does not contain the fatty alcohol as required by the invention).

Having thus described the invention in detail, it will be clear to those skilled in the art that various changes may be made without departing from the scope of the invention and the invention is not to be considered limited to what is described in the specification.

What is claimed is:

1. A granular laundry detergent composition which reduces the formation of excess clumps or solid masses comprising:

(a) from about 5% to about 20% by weight of a $C_{12-14}$ linear alkylbenzene sulfonate surfactant;

(b) from about 5% to about 20% by weight of a $C_{14-15}$ alkyl sulfate surfactant;

(c) from about 0.1% to about 10% by weight of a $C_{14-15}$ alkyl ethoxylated sulfate surfactant having an average degree of ethoxylation of from about 1 to 9;

(d) from about 0.1% to about 5% by weight of polyethylene glycol;

(e) from about 0.1% to about 5% by weight of polyacrylate;

(f) from about 10% to about 35% by weight of aluminosilicate builder;

(g) from about 10% to about 35% by weight of sodium carbonate; and (h) from about 1.5% to about 3.5% by weight of a $C_{10-14}$ fatty alcohol.

2. The detergent composition of claim 1 wherein said fatty alcohol is a $C_{10}$ fatty alcohol.

3. The detergent composition of claim 1 wherein said fatty alcohol is present in an amount from about 1% to about 5% by weight.

4. The detergent composition of claim 1 wherein said fatty alcohol is a $C_{12}$ fatty alcohol.

5. The detergent composition of claim 1 wherein said fatty alcohol is a $C_{14}$ fatty alcohol.

6. The detergent composition of claim 1 wherein said $C_{12-14}$ linear alkylbenzene sulfonate surfactant is present in an amount from about 10% to about 15% by weight.

7. The detergent composition of claim 1 wherein said $C_{14-15}$ alkyl sulfate surfactant is present in an amount from about 5% to about 10% by weight.

8. The detergent composition of claim 1 wherein said $C_{14-15}$ alkyl ethoxylated sulfate surfactant is present in an amount from about 1% to about 5% by weight.

9. The detergent composition of claim 1 wherein said aluminosilicate is present in an amount of from about 15% to about 30% by weight.

* * * * *